United States Patent [19]

Ueno et al.

[11] 4,237,839

[45] Dec. 9, 1980

[54] AIR-FUEL RATIO DETECTING SYSTEM

[75] Inventors: Yoshiki Ueno, Aichi; Tadashi Hattori, Okazaki, both of Japan

[73] Assignee: Nippon Soken, Inc., Nishio, Japan

[21] Appl. No.: 18,775

[22] Filed: Mar. 8, 1979

[30] Foreign Application Priority Data

Jun. 22, 1978 [JP] Japan ..... 53-75725

[51] Int. Cl.[3] ..... F02D 5/00; F02B 3/08

[52] U.S. Cl. ..... 123/440; 123/489

[58] Field of Search ..... 123/119 EC, 32 EE, 32 EA; 60/276, 285; 73/23

[56] References Cited

U.S. PATENT DOCUMENTS

| | | | |
|---|---|---|---|
| 4,140,085 | 2/1979 | Rabas et al. | 123/32 EE |
| 4,156,413 | 5/1979 | Taplin | 123/119 EC |

*Primary Examiner*—Charles J. Myhre
*Assistant Examiner*—R. A. Nelli
*Attorney, Agent, or Firm*—Cushman, Darby & Cushman

[57] ABSTRACT

An air-fuel ratio sensor exhibiting a resistance value variable depending on the concentration of oxygen in exhaust gases is disposed in the exhaust system of an internal combustion engine and is connected in series with a variable resistance unit. Strobe signals are produced when the potential level at the connection point between the air-fuel ratio sensor and the variable resistance unit crosses a reference potential level. A maximum value and a minimum value of the potential at this connection point are sampled and held in a sampling circuit to be applied to a computation circuit in response to the strobe signals. The computation circuit computes the aforementioned reference voltage on the basis of the detected maximum and minimum values of the potential at the connection point. The reference potential and the resistance value of the variable resistance unit vary in relation to the maximum and minimum potential values sampled and held in the sampling circuit.

4 Claims, 8 Drawing Figures

AIR-FUEL RATIO DETECTING SYSTEM

BACKGROUND OF THE INVENTION

This invention relates to an air-fuel ratio detecting system for an internal combustion engine for detecting the air-fuel ratio of the air-fuel mixture supplied to the engine on the basis of the concentration of a gas component of engine exhaust gases.

An air-fuel ratio detecting system for an internal combustion engine has been proposed already for detecting the air-fuel ratio A/F of the air-fuel mixture supplied to the engine on the basis of the concentration of a gas component, for example, oxygen in engine exhaust gases. The proposed air-fuel ratio detecting system comprises an air-fuel ratio sensor including an element of a metal oxide semiconductor as its principal component to exhibit an electrical resistance value which is dependent upon the concentration of oxygen present in engine exhaust gases. This air-fuel ratio sensor is connected to a dividing resistor having a fixed resistance value, and the voltage appearing at the connection point between the sensor and the resistor is compared with a predetermined reference voltage in a comparison circuit so as to detect whether the air-fuel ratio of the air-fuel mixture supplied to the engine is larger or smaller than the stoichiometric air-fuel ratio.

However, the conventional air-fuel ratio detecting system, in which the dividing resistor of fixed resistance value is connected to the air-fuel ratio sensor, has been defective in that an overall shift of the characteristic curve of the electrical resistance value $R_e$ of the air-fuel ratio sensor due to the ambient temperature or aging tends to give rise to an undesirable reduction of the accuracy of detection of the air-fuel ratio, and an erroneous value of the air-fuel ratio will be detected in such a case.

SUMMARY OF THE INVENTION

With a view to obviate the defect of the conventional system pointed out above, it is a primary object of the present invention to provide a novel and improved air-fuel ratio detecting system for an internal combustion engine which can detect the air-fuel ratio with a satisfactorily high accuracy regardless of the overall shift of the characteristic curve of the electrical resistance value $R_e$ of the air-fuel ratio sensor due to the ambient temperature and aging.

The present invention which obviates the defect of the conventional system is featured by the fact that the air-fuel ratio sensor is connected in series with a variable resistance unit, and the voltage values at the rich and lean air-fuel ratio portions appearing at the connection point between the air-fuel ratio sensor and the variable resistance unit are detected at predetermined times so as to vary the electrical resistance value $R_e$ of the variable resistance unit depending on a value intermediate between these detected voltage values, whereby the accuracy of detection of the air-fuel ratio can be improved, and the possibility of erroneous detection can be obviated.

DESCRIPTION OF THE PREFERRED EMBODIMENTS

Preferred embodiments of the present invention will now be described in detail with reference to the accompanying drawings.

Figure 2:
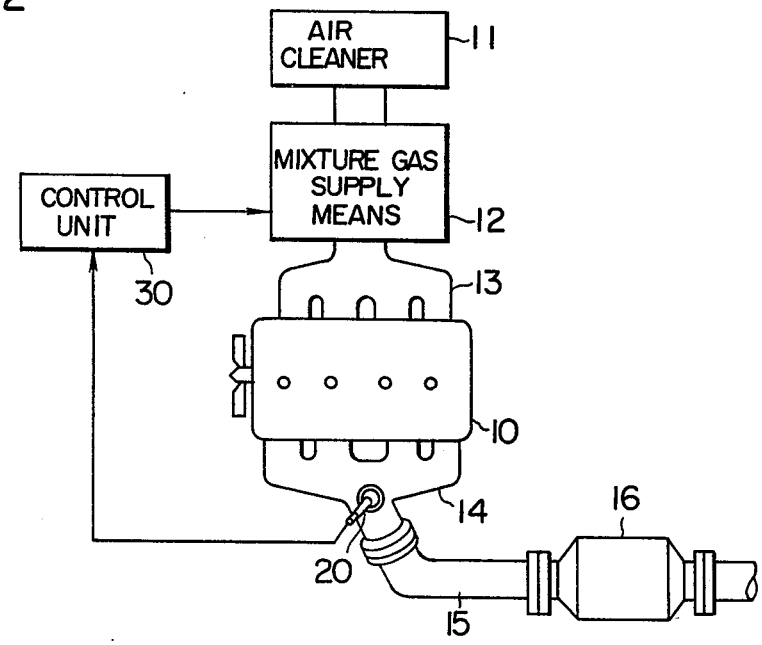
FIG. 2 is a diagrammatic general view of an engine system to which the present invention is applied.

Referring first to FIG. 2 showing an engine system to which the present invention is applied, an engine 10 of spark ignition type commonly known in the art operates with fuel such as gasoline or LPG. The engine 10 is provided with an intake system including an air cleaner 11, a mixture gas supplying unit 12 and an intake manifold 13, and with an exhaust system including an exhaust manifold 14, an exhaust pipe 15, an exhaust-gas purifying three-way catalytic converter 16 and a silencing muffler (not shown).

The mixture gas supplying unit 12 includes a carburetor or a fuel injector provided with a known electronic air-fuel ratio regulator so that the air-fuel ratio of the air-fuel mixture supplied to the engine 10 through the intake system can be varied in response to an electrical control signal. The three-way catalytic converter 16 contains a known three-way catalyst in the form of pellets or a honeycomb structure so that, when the air-fuel mixture supplied to the engine 10 has an air-fuel ratio close to the stoichiometric air-fuel ratio, the toxic exhaust gas components such as $NO_x$, HC and CO can be removed at the same time to purify the engine exhaust gases at a high purification rate.

An embodiment of the air-fuel ratio detecting system according to the present invention comprises an air-fuel ratio sensor 20 located on the neck portion of the exhaust manifold 14 and a control unit 30 connected between the air-fuel ratio sensor 20 and the mixture gas supplying unit 12 for applying an electrical control signal to the mixture gas supplying unit 12.

Figure 3:
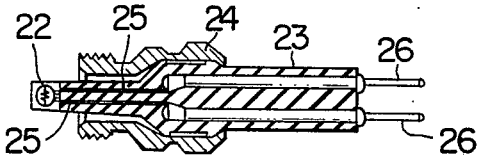
FIG. 3 is a schematic longitudinal sectional view of the air-fuel ratio sensor shown in FIG. 2.

The air-fuel ratio sensor 20 has a structure as shown in FIG. 3. Referring to FIG. 3, the air-fuel ratio sensor 20 includes a generally disc-shaped element 22 whose electrical resistance value varies stepwise in relation to the concentration of a gas component, especially, oxygen present in the engine exhaust gases. This element 22 is formed of a metal oxide semiconductor such as titania ($TiO_2$) and carries a catalyst such as platinum (Pt) ro rhodium (Rh) on its surface. The element 22 is supported on a tip portion of a supporting member 23 of a heat-resisting electrical insulator which may be a sintered material such as alumina. The supporting member 23 is partly received in a housing 24 of a heat-resisting metal, and this housing 24 is partly externally threaded to make threaded engagement with a mating threaded portion of the exhasut manifold 14.

A pair of electrodes 25 of a metal such as platinum extend through a body portion of the supporting member 23 to be inserted at one end thereof into the element 22 and are connected electrically at the other end thereof to a pair of leads 26 through beads of conductive glass respectively. Thus, the electrical resistance value of the element 22 can be derived from the leads 26.

Figure 1:
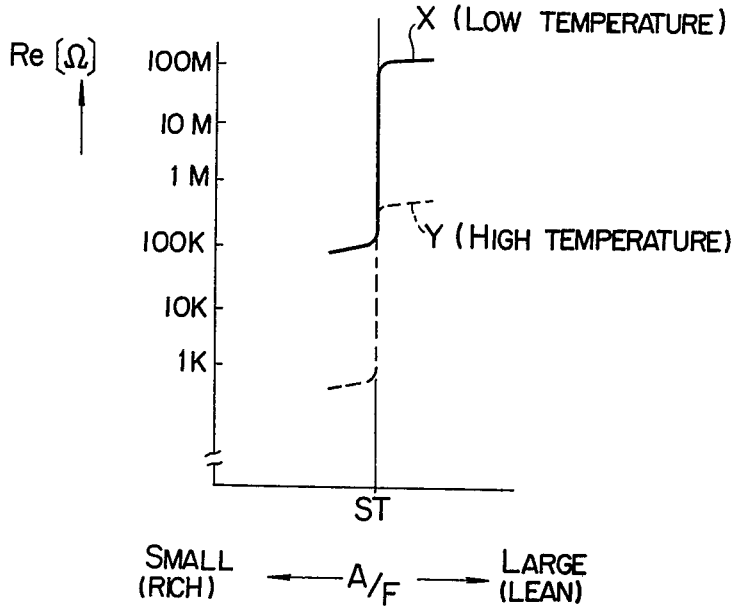
FIG. 1 is a graph showing the characteristic curve of the electrical resistance value $R_e$ of an air-fuel ratio sensor.

The electrical resistance value $R_e$ of the air-fuel ratio sensor 20 varies in a manner as shown in FIG. 1 in relation to the air-fuel ratio A/F of the air-fuel mixture supplied to the engine 10 from the mixture gas supplying unit 12. It will be seen in FIG. 1 that the air-fuel ratio sensor 20 exhibits a lean mixture representing resistance when the air-fuel ratio A/F of the air-fuel mixture supplied to the engine 10 from the mixture gas supplying unit 12 is larger than the stoichiometric air-fuel ratio (referred to hereinafter as ST), that is, when the air-fuel ratio A/F lies on the leaner side of the stoichiometic air-fuel ratio ST, and oxygen is present in the engine exhaust gases. On the other hand, the air-fuel ratio sensor 20 exhibits a rich mixture representing resistance as seen in FIG. 1 when the air-fuel ratio A/F lies on the richer side of the stoichiometric air-fuel ratio ST, and oxygen is not present in the engine exhaust gases. This characteristic curve of the electrical resistance value $R_e$ of the air-fuel ratio sensor 20 makes an overall shift depending on the ambient temperature and aging. The solid curve X in FIG. 1 represents the electrical resistance characteristic of the air-fuel ratio sensor 20 when it is new and the ambient temperature is relatively low. The curve X shifts bodily toward the dotted curve Y shown in FIG. 1 in response to an elevation of the ambient temperature even when the sensor 20 is new, or when aging occurs on the sensor 20.

Figure 4:
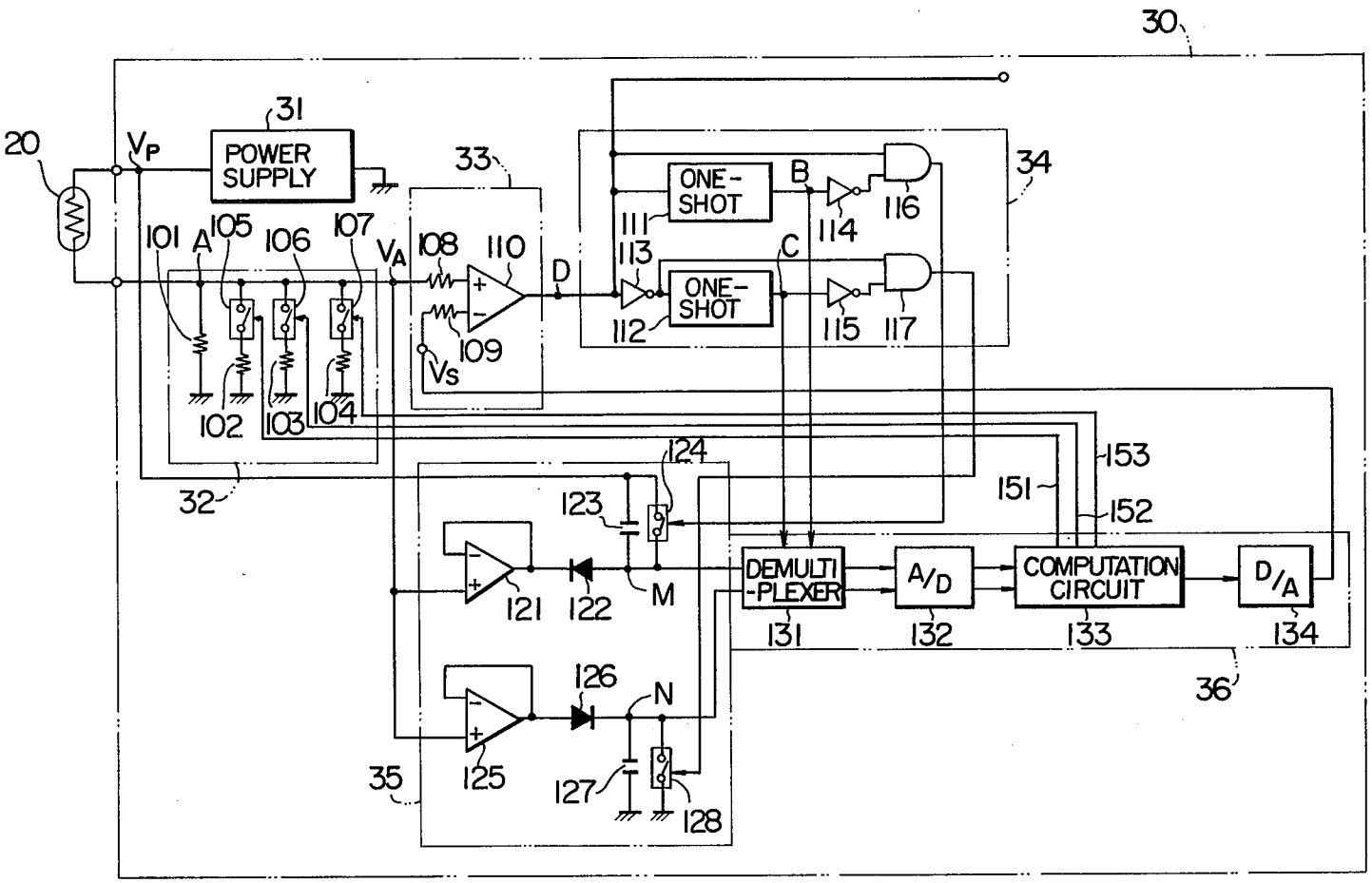
FIG. 4 is an electrical circuit diagram of a preferred embodiment of the air-fuel ratio detecting system according to the present invention.

The strusture and operation of the control unit 30 will be described with reference to FIG. 4. Referring to FIG. 4, a power supply 31 which supplies a constant DC voltage $V_p$ is connected at one terminal thereof to one terminal of the air-fuel ratio sensor 20 and is grounded at the other terminal thereof.

A variable resistance unit 32 is connected in series with the other terminal of the air-fuel ratio sensor 20 at a connection point A. This variable resistance unit 32 includes four dividing resistors 101, 102, 103 and 104 each of which is grounded at one end thereof. The first dividing resistor 101 is directly connected to the air-fuel ratio sensor 20, while the remaining second, third and fourth dividing resistors 102, 103 and 104 are connected to the air-fuel ratio sensor 20 through semiconductor analog switches 105, 106 and 107, respectively. These analog switches 105 to 107 are of the type commonly known in the art and are turned on in response to the application of a signal of "1" level, while they are turned off in response to the application of a signal of "0" level. Thus, any detailed description of these analog switches 105 to 107 is unnecessary.

A comparison circuit 33 includes a pair of input resistors 108, 109 and a comparator 110. A voltage $V_A$ appearing at the connection point A between the air-fuel ratio sensor 20 and the variable resistance circuit 32 is applied to the non-inverted input terminal (+) of the comparator 110, while a reference voltage $V_s$ is applied to the inverted input terminal (−) of the comparator 110. A rich signal of "1" level appears from the comparator 110 when the voltage $V_A$ is higher than the reference voltage $V_s$, while a lean signal of "0" level appears from the comparator 110 when the voltage $V_A$ is lower than the reference voltage $V_s$.

A timing circuit 34 includes a pair of monostable circuits 111, 112, three inverters 113, 114, 115 and a pair of AND gates 116, 117. This timing circuit 34 generates strobe signals used for the control of a demultiplexer 131 described later and generates also control signals used for the on-off control of the analog switches 105 to 107. The monostable circuit 111 generates a strobe signal of "1" level having a pulse width t at the rise time of the output signal of the comparator 110 in the comparison circuit 33, that is, as soon as the output signal level of the comparator 110 is inverted from the "0" level to the "1" level. The AND gate 116 provides an output signal of "1" level when the output signal of the comparator 110 is of "1" level and the output signal of the monostable circuit 111 is of "0" level.

The monostable circuit 112 generates similarly a strobe signal of "1" level having a pulse width t at the fall time of the output signal of the comparator 110, that is, as soon as the output signal level of the comparator 110 is inverted from the "1" level to the "0" level. The AND gate 117 provides an output signal of "1" level when the output signals of the comparator 110 and monostable circuit 112 are both of "0" level.

A peak sampling circuit 35 includes a lean peak sampling circuit and a rich peak sampling circuit. The lean peak sampling circuit includes a buffer amplifier 121 of voltage follower connection, a diode 122, a capacitor 123 connected to be charged from the power supply 31 and to discharge depending on the output of the buffer amplifier 121, and a semiconductor analog switch 124 connected in parallel with the capacitor 123. The rich peak sampling circuit includes a buffer amplifier 125 similar to the buffer amplifier 121, a diode 126, a capacitor 127 connected to be charged by the output of the buffer amplifier 125, and a semiconductor analog switch 128 connected in parallel with the capacitor 127.

Figure 6:
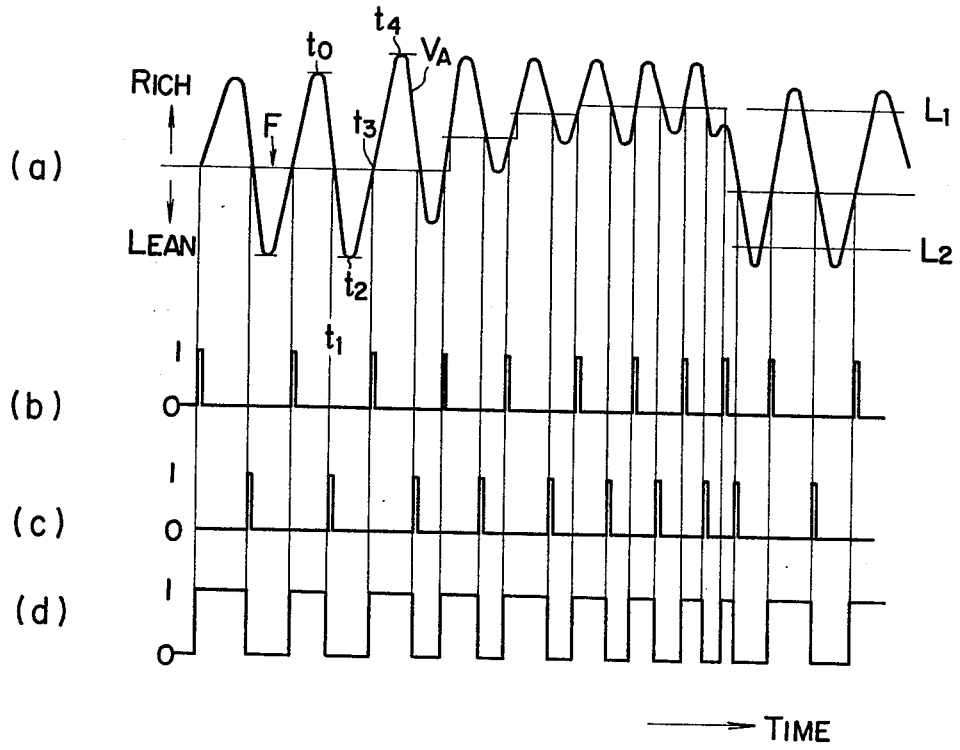
FIGS. 6 and 7 are graphs illustrating the operation of the air-fuel ratio detecting system of the present invention.

The voltage at the terminal M of the capacitor 123 in the lean peak sampling circuit decreases with the decrease in the voltage $V_A$ at the connection point A so that the lean peak sampling circuit detects and holds the value of the voltage $V_A$ when it attains a lean peak value $V_{min}$ at time $t_2$ as, for example, shown in (a) of FIG. 6. On the other hand, the voltage at the terminal N of the capacitor 127 in the rich peak sampling circuit increases with the increase in the voltage $V_A$ at the connection point A so that the rich peak sampling circuit detects and holds the value of the voltage $V_A$ when it attains rich peak values $V_{max}$ at times $t_0$ and $t_4$ as, for example, shown in (a) of FIG. 6.

The voltage $V_A$ appearing at the connection point A is applied to the non-inverted input terminal (+) of each of the buffer amplifiers 121 and 125, and the voltage appearing at the output of each of these buffer amplifiers 121 and 125 is fed back to their inverted input terminal (−). Therefore, the output voltage of these buffer amplifiers 121 and 125 is approximately equal to the voltage $V_A$. The analog switches 124 and 128 are on-off controlled by the output signals of the AND gates 116 and 117 in the timing circuit 34, respectively. Thus, these analog switches 124 and 128 are turned on in response to the application of the output signal "1" level from the associated AND gates 116 and 117, and are not turned on when the AND gates 116 and 117 provide their output signals of "0" level. Thus, the capacitor 123 in the lean peak sampling circuit discharges during the period of time in which the rich signal of "1" level delivered from the comparison circuit 33 appears at the point D and when the monostable circuit 111 generates its output signal of "0" level. On the other hand, the capacitor 127 in the rich peak sampling circuit discharges during the period of time in which the lean signal of "0" level is delivered from the comparison circuit 33 and when the monostable circuit 112 generates its output signal of "0" level.

A control circuit 36 includes a demultiplexer 131 selectively receiving two input signals, an analog-to-digital (A/D) converter 132 converting the analog voltage output of the demultiplexer 131 into a binary digital signal, a computation circuit 133 carrying out necessary computation on the binary digital input, and a digital-to-analog (D/A) converter 134 converting the digital output of the computation circuit 133 into an analog voltage which is applied to the comparison circuit 33 as the reference voltage $V_s$.

The demultiplexer 131 of the type commonly known in the art and is constructed to selectively receive the two input signals from the peak sampling circuit 35 to distribute these two input signals into two channels depending on the strobe signals applied from the monostable circuits 111 and 112 in the timing circuit 34. More precisely, the demultiplexer 131 receives the lean peak voltage $V_{min}$ stored in the capacitor 123 when the strobe signal of "1" level is applied from the output terminal B of the monostable circuit 111, while it receives the rich peak voltage $V_{max}$ stored in the capacitor 127 when the strobe signal of "1" level is applied from the output terminal C of the monostable circuit 112.

The computation circuit 133 computes a value intermediate between the rich and lean peak voltages $V_{max}$ and $V_{min}$, which have been received by the demultiplexer 131 and then converted into the digital signals by the A/D converter 132, to apply the resultant output to the D/A converter 134. The computation circuit 133 is also constructed to apply on-off control signals to the analog switches 105 to 107 depending on the result of computation.

Figure 5:
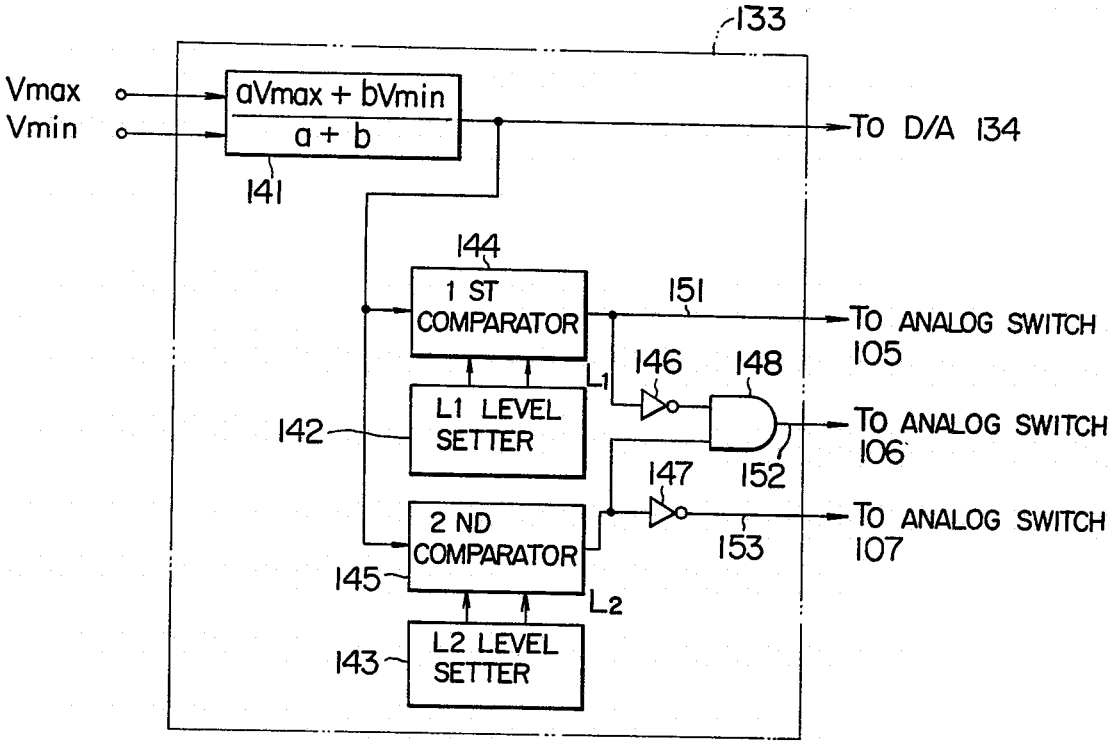
FIG. 5 is an electrical circuit diagram showing in detail the structure of the computation circuit shown in FIG. 4.

FIG. 5 shows the structure of one form of the computation circuit 133. Referring to FIG. 5, the computation circuit 133 includes an arithmetic unit 141, a first level setter 142, a second level setter 143, a first comparator 144, a second comparator 145, inverters 146, 147 and an AND gate 148. The arithmetic unit 141 computes the value $V_s$ intermediate between the rich and lean peak voltage values $V_{max}$ and $V_{min}$ according to the following equation (1):

$$V_s = 1/(a+b)(a \cdot V_{max} + b \cdot V_{min}) \quad (1)$$

where a and b are constants. The first level setter 142 generates a binary digital output signal representing a first level setting $L_1$, and the second level setter 143 generates similarly a binary digital output signal representing a second level setting $L_2$. These digital output signals are applied from the first and second level setters 142 and 143 to the first and second comparators 144 and 145 respectively to be compared with the digital output signal of the arithmetic unit 141.

The comparator 144 generates an output signal of "1" level when the level of the digital output signal of the arithmetic unit 141 representing the value $V_s$ intermediate between the rich and lean peak values $V_{max}$ and $V_{min}$ is higher than the first level setting $L_1$, and it generates an output signal of "0" level when the value $V_s$ is smaller than the setting $L_1$. Similarly, the comparator 145 generates an output signal of "1" level when the value $V_s$ is larger than the second level setting $L_2$, and it generates an output signal of "0" level when the value $V_s$ is smaller than the setting $L_2$. The constants a and b in the equation (1) computed by the arithmetic unit 141 are generally selected to be $a=b=1$ to provide the following equation (2):

$$V_s = \tfrac{1}{2}(V_{max} + V_{min}) \quad (2)$$

However, depending on the kind of the air-fuel ratio sensor 20, the constants a and b may be selected to have other values which are considered to be optimum.

The output signals of the first comparator 144, AND gate 148 and inverter 147 are applied to the analog switches 105, 106 and 107 by way of leads 151, 152 and 153 respectively for the on-off control of the analog switches 105, 106 and 107.

The electrical resistance value $R_e$ of the air-fuel ratio sensor 20 in the air-fuel ratio detecting system having the structure shown in FIG. 2 varies depending on the concentration of a gas component, especially, oxygen present in the exhaust gases discharged from the engine 10. Since the concentration of this specific exhaust gas component varies in relation to the air-fuel ratio A/F of the air-fuel mixture supplied from the mixture gas supplying unit 12 to the engine 10, the electrical resistance value $R_e$ of the air-fuel ratio sensor 20 varies relative to the air-fuel ratio A/F in a manner as shown in FIG. 1. It will be seen in FIG. 1 that the electrical resistance value $R_e$ of the air-fuel ratio sensor 20 is relatively large in the zone in which the air-fuel ratio A/F is larger than the stoichiometric air-fuel ratio ST (=14.7), and it is relatively small in the zone in which the air-fuel ratio A/F is smaller than the stoichiometric air-fuel ratio ST.

The voltage $V_A$ at the connection point A is determined by the electrical resistance value $R_e$ of the air-fuel ratio sensor 20 and varies relative to the variation of the air-fuel ratio A/F in a manner as shown by the curve $V_A$ in (a) of FIG. 6.

Suppose now that the reference voltage $V_s$ generated by the control circuit 36 has a level as shown by F in (a) of FIG. 6. Then, during the period of time in which the voltage $V_A$ at the connection point A is higher than the reference voltage $V_s$ having the level F, a rich signal of "1" level appears from the comparison circuit 33 as shown in (d) of FIG. 6. Therefore, when the voltage $V_A$ starts to decrease to a level lower than that of the reference voltage $V_s$ at time $t_1$, the output of the comparison circuit 33 is inverted from the "1" level to the "0" level, and a strobe signal appears from the monostable circuit 112 as shown in (c) of FIG. 6.

At this time $t_1$, the analog switch 128 in the peak sampling circuit 35 is still in its off-state, and the voltage level at the terminal N of the capacitor 127 is maintained at the rich peak value $V_{max}$ detected and held at time $t_0$. In response to the application of the strobe signal from the monostable circuit 112, the demultiplexer 131 receives the rich peak voltage $V_{max}$ from the peak sampling circuit 35. In response to the level inversion of the strobe signal from the "1" level to the "0" level as shown in (c) of FIG. 6, an output signal of "1" level appears from the AND gate 117 to turn on the analog switch 128 thereby permitting discharge of the charge stored in the capacitor 127.

On the other hand, in response to the level inversion of the output signal of the comparison circuit 33 from the "1" level to the "0" level, an output signal of "0" level appears from the AND gate 116 to turn off the analog switch 124 so that the capacitor 123 starts to be charged. Consequently, the voltage level at the terminal M of the capacitor 123 decreases with the decrease in the output voltage of the buffer amplifier 121, hence, the voltage $V_A$ at the connection point A, and when the lean peak voltage $V_{min}$ is reached at time $t_2$, this peak voltage $V_{min}$ is detected and held in the lean peak sampling circuit.

At time $t_3$, the voltage $V_A$ at the connection point A starts to become higher than the reference voltage $V_s$, and the output signal of the comparison circuit 33 is inverted from the "0" level to the "1" level as shown in (d) of FIG. 6. As a result of this level inversion of the output signal of the comparison circuit 33, a strobe signal of "1" level appears from the monostable circuit 111 as shown in (b) of FIG. 6.

At this time $t_3$, the analog switch 124 in the peak sampling circuit 35 is still in its off-state, and the voltage level at the terminal M of the capacitor 123 is maintained at the lean peak value $V_{min}$ detected and held at time $t_2$. In response to the application of the strobe signal from the monostable circuit 111, the demultiplexer 131 receives the lean peak voltage $V_{min}$ from the peak sampling circuit 35. Then, in response to the level inversion of the strobe signal from the "1" level to the "0" level as shown in (b) of FIG. 6, an output signal of "1" level appears from the AND gate 116 to turn on the analog switch 125 thereby permitting discharge of the charge stored in the capacitor 123.

On the other hand, in response to the level inversion of the output signal of the comparison circuit 33 from the "0" level to the "1" level, an output signal of "0" level appears from the AND gate 117 to turn off the analog switch 128 so that the capacitor 127 starts to be charged. Consequently, the voltage level at the terminal N of the capacitor 127 increases with the increase in the output voltage of the buffer amplifier 125, hence, the voltage $V_A$ at the connection point A, and when the rick peak voltage $V_{max}$ is reached at time $t_4$, this rich peak voltage $V_{max}$ is detected and held in the rich peak sampling circuit.

Thereafter, the operation above described is sequentially repeated by the circuits to alternately supply the rich and lean peak voltages $V_{max}$ and $V_{min}$ to the demultiplexer 131.

The rich and lean peak voltages $V_{max}$ and $V_{min}$ supplied to the demultiplexer 131 are converted into corresponding digital signals which are applied to the computation circuit 133. In the computation circuit 133, the value $V_s$ intermediate between the rich and lean peak values $V_{max}$ and $V_{min}$ is computed, and the resultant digital signal is converted by the D/A converter 134 into an analog voltage which is supplied to the comparison circuit 33 as the reference voltage $V_s$.

Further, in the computation circuit 133, the digital output of the arithmetic unit 141 is monitored by the first and second comparators 144 and 145, so that the analog switches 105 to 107 can be on-off controlled to vary the electrical resistance value of the variable resistance unit 32 depending on the value $V_s$ intermediate between the rich and lean peak values $V_{max}$ and $V_{min}$, that is, depending on the level of the reference voltage $V_s$.

Thus, when the reference voltage $V_s$ has a level higher than the first level setting $L_1$ shown in (a) of FIG. 6, the output signals of "1" appear at the same time from the first and second comparators 144 and 145, and the output signal of "1" level appearing from the first comparator 144 is applied by way of the lead 151 to the first analog switch 105 in the variable resistance unit 32 to turn on this analog switch 105 only.

When the reference voltage $V_s$ has a level intermediate between the first level setting $L_1$ and the second level setting $L_2$ shown in (a) of FIG. 6, the output signal of "0" level and the output signal of "1" level appear from the first and second comparators 144 and 145 respectively, and the output signal of "1" level appearing from the AND gate 148 is applied by way of the lead 152 to the second analog switch 106 in the variable resistance unit 32 to turn on this analog switch 106 only.

When the reference voltage $V_s$ has a level lower than the second level setting $L_2$ shown in (a) of FIG. 6, the output signals of "0" level appear from both of the first and second comparators 144 and 145, and the output signal of "1" level appearing from the inverter 147 is applied by way of the lead 153 to the third analog switch 107 in the variable resistance unit 32 to turn on this analog switch 107 only.

The electrical resistance value of the variable resistance unit 32 is a variable over three stages depending on the level of the reference voltage $V_s$ which represents the value intermediate between the rich and lean peak values $V_{max}$ and $V_{min}$. In the embodiment of the present invention, the electrical resistance values R(102), R(103) and R(104) of the respective resistors 102, 103 and 104 are selected to satisfy the following relation:

$$R(102) < R(103) < R(104)$$

Therefore, the electrical resistance value of the variable resistance unit 32 becomes lower stepwise with the increase in the value of the reference voltage $V_s$.

Suppose, for example, that the voltage $V_p$ of the power supply 31 is 8 volts, the combined resistance value of the resistors 101 and 102 is 10 kΩ, and the combined resistance value of the resistors 101 and 103 is 1 MΩ. Then, in the condition in which the ambient temperature of the air-fuel ratio sensor 20 is relatively low and the second analog switch 106 is turned on, the electrical resistance value $R_e$ of the air-fuel ratio sensor 20 is about 100 MΩ when the air-fuel ratio A/F lies on the leaner side of the stoichiometric air-fuel ratio ST, and about 100 KΩ when the air-fuel ratio A/F lies on the richer side of the stoichiometric air-fuel ratio ST, as seen in FIG. 1. In this case, the voltage $V_A$ appearing at the connection point A makes such a great variation as shown by the solid curve I in FIG. 7. It will be seen in FIG. 7 that the voltage $V_A$ appearing at the connection point A varies between about 0.08 volt and about 7.27 volts depending on whether the air-fuel ratio A/F lies on the leaner or richer side of the stoichiometric air-fuel ratio ST.

Thus, when the reference voltage $V_s$ computed by the computation circuit 133 is selected to be $V_s = 3.675$ $[=\frac{1}{2}(0.08+7.27)]$volts in such a case, whether the air-fuel ratio A/F is larger or smaller than the stoichiometric air-fuel ratio ST can be accurately determined on the basis of the variation of the electrical resistance value $R_e$ of the air-fuel ratio sensor 20.

In the condition in which the ambient temperature of the air-fuel ratio sensor 20 is elevated, its electrical resistance value $R_e$ is about 300 kΩ when the air-fuel ratio A/F lies on the leaner side of the stoichiometric air-fuel ratio ST, and about 500 Ω when the air-fuel ratio A/F lies on the richer side of the stoichiometric air-fuel ratio ST, as seen in FIG. 1. The voltage $V_A$ appearing at the connection point A will not make an aappreciable variation in such a case when the electrical resistance value of the variable resistance unit 32 is fixed at 1 MΩ. That is, the voltage $V_A$ varies only between about 6.2 volts and about 7.9 volts even when the air-fuel ratio A/F varies between the leaner and richer sides of the stoichiometric air-fuel ratio ST, and this results in a poor accuracy of detection of the air-fuel ratio A/F.

According to the present invention which obviates this undesirable reduction in the detection accuracy, the value $V_s$ intermediate between the detected rich and lean peak values $V_{max}$ and $V_{min}$ is computed so as to vary the electrical resistance value of the variable resistance unit 32 on the basis of the computed intermediate value. Thus, when the ambient temperature of the air-fuel ratio sensor 20 is elevated and the value $V_s$ intermediate between the detected rich and lean peak values $V_{max}$ and $V_{min}$ exceeds the first level setting $L_1$, the first analog switch 105 only is turned on to change over the electrical resistance value of the variable resistance unit 32 to 10 kΩ.

Figure 7:
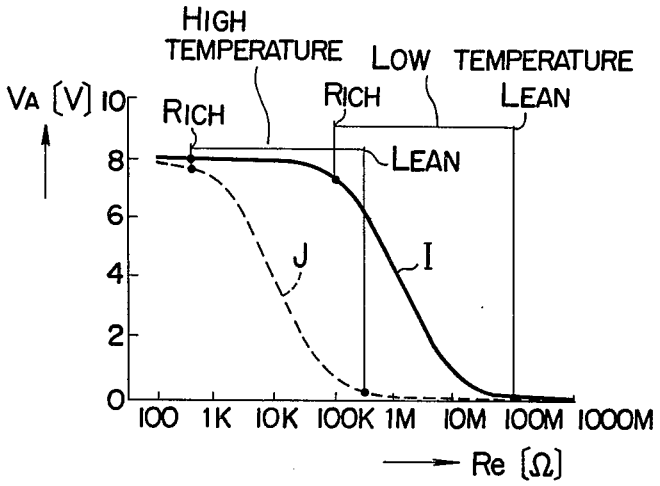

Due to such a change-over of the electrical resistance value of the variable resistance unit 32, the voltage $V_A$ appearing at the connection point A makes also a great variation at the high ambient temperature as shown by the dotted curve J in FIG. 7. It will be seen in FIG. 7 that the voltage $V_A$ varies between about 0.26 volts and about 7.62 volts depending on whether the air-fuel ratio A/F lies on the leaner or richer side of the stoichiometric air-fuel ratio ST, so that the high accuracy of detection of the air-fuel ratio A/F can be satisfactorily maintained without being degraded in any way.

In the embodiment of the present invention, the reference voltage $V_S$ representing the value intermediate between the detected rich and lean peak values $V_{max}$ and $V_{min}$ is applied to the comparison circuit 33 so as to further improve the accuracy of detection of the air-fuel ratio A/F.

Thus, although the characteristic curve of the electrical resistance value $R_e$ of the air-fuel ratio sensor 20 makes an overall shift under the influence of the factors such as the ambient temperature and aging as described with reference to FIG. 1, the air-fuel ratio A/F can be accurately detected to be larger or smaller than the stoichiometric air-fuel ratio ST, regardless of the overall shift of the characteristic curve the electrical resistance value $R_e$ of the air-fuel ratio sensor 20, when the comparison circuit 33 delivers the air-fuel ratio detection output signal of "0" level or "1" Level respectively.

The air-fuel ratio detection output signal of the comparison circuit 33 is applied through a driver circuit (not shown) to the mixture gas supplying unit 12. When the air-fuel ratio detection output signal of "0" level is applied, the electronic air-fuel ratio regulator in the mixture gas supplying unit 12 acts to increase the proportion of fuel in the air-fuel mixture thereby decreasing the air-fuel ratio A/F until the air-fuel ratio A/F attains the stoichiometric air-fuel ratio ST.

On the other hand, when the air-fuel ratio detection output signal of "1" level is applied, the air-fuel ratio regulator in the mixture gas supplying unit 12 acts to decrease the proportion of fuel in the air-fuel mixture thereby increasing the air-fuel ratio A/F until the air-fuel ratio A/F attains the stoichiometric air-fuel ratio ST.

Thus, the air-fuel ratio A/F can be always accurately controlled to be equal to the stoichiometric air-fuel ratio ST, and the three-way catalytic converter 16 can satisfactorily purify the engine exhaust gases with a high purification rate by substantially completely removing $NO_X$, HC and CO from the engine exhaust gases.

Figure 8:
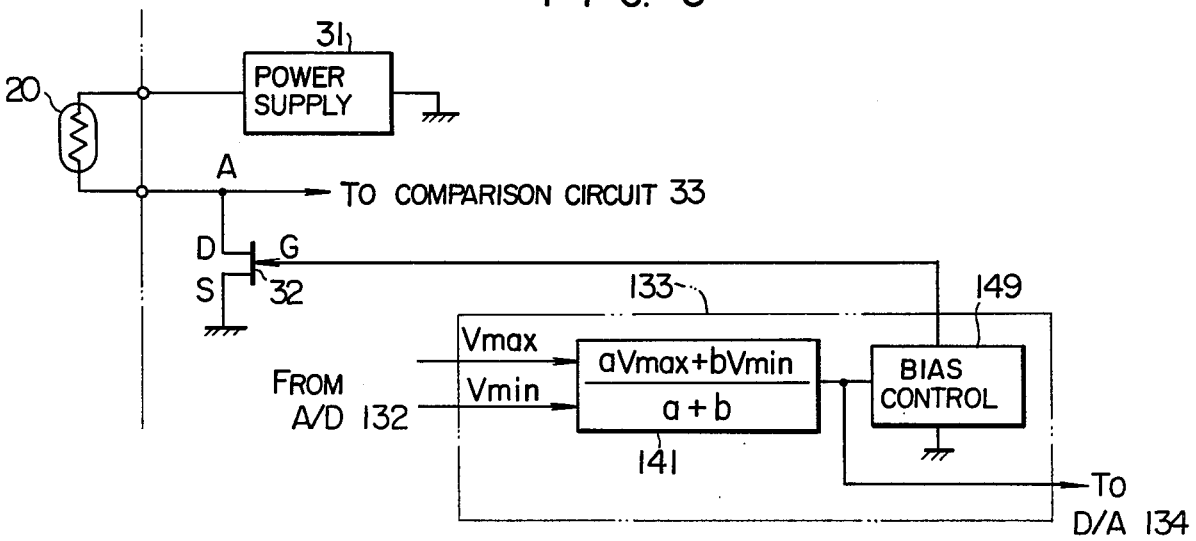
FIG. 8 is an electrical circuit diagram showing a partial modification of the air-fuel ratio detecting system shown in FIG. 4.

In the embodiment above described, a plurality of resistors 101 to 104 and a plurality of analog switches 105 to 107 are employed to constitute the variable resistance unit 32 whose electrical resistance value is variable stepwise. In a partial modification shown in FIG. 8, the elements 101 to 107 constituting the variable resistance unit 32 are replaced by a single field effect transistor (FET) as shown. In this modification, a bias control circuit 149 is provided in the computation circuit 133 to vary the gate bias voltage for the FET 32 depending on the result of computation by the arithmetic unit 141. This bias control circuit 149 acts to reduce the gate bias voltage thereby decreasing the electrical resistance value between the drain and the source of the FET 32 with the increase in the computed intermediate value $V_s$ of the rich and lean peak values $V_{max}$ and $V_{min}$.

In the aforementioned embodiment of the present invention, the peak sampling circuit 35 has been constructed to detect and hold the values of the voltage $V_A$ when the voltage $V_A$ attains its rich and lean peak values $V_{max}$ and $V_{min}$. However, the waveform of the voltage $V_A$ may be sampled at predetermined times counting from the rise time and fall time of the output signal of the comparison circuit 33 so as to detect and hold the values of the voltage $V_A$ on the rich and lean waveform portions at the predetermined times, and the value intermediate between these detected values of the voltage $V_A$ may be computed in the computation circuit 133.

Further, although the present invention has been described with reference to its application to the system controlling the air-fuel ratio A/F of the air-fuel mixture in the engine intake system, it is apparent that the present invention is equally effectively applicable to the system controlling the air-fuel ratio A/F of the exhaust in the engine exhaust system by controlling the amount of secondary air supplied to the engine exhaust system on the basis of the electrical resistance value $R_e$ of the air-fuel ratio sensor 20.

We claim:

1. An air-fuel ratio detecting system for internal combustion engines comprising:

oxygen detecting means disposed in an exhaust passage of an internal combustion engine for detecting an absence and presence of oxygen, said oxygen detecting means exhibiting a low resistance and a high resistance in response to said absence and said presence of oxygen in said exhaust passage, respectively;

variable resistance means connected in series with said oxygen detecting means;

power supply means for supplying a series circuit of said oxygen detecting means and said variable resistance means with an electric power so that said series circuit develops a first and a second voltages in response to said low resistance and said high resistance of said oxygen detecting means, respectively, at a junction between said oxygen detecting means and said variable resistance means;

sampling means for sampling a maximum value of larger one of said first and second voltages and a minimum value of smaller one of said first and second voltages during a sampling period;

calculation means for calculating a reference value in proportion to both of said maximum and minimum values;

resistance control means for controlling resistance of said variable resistance means in response to said reference value, said reference value in turn being varied in accordance with changes of said maximum and minimum values due to the resistance control by said resistance control means; and comparison means for comparing said first and second voltages with said reference value so that an air-fuel ratio of mixture supplied to said internal combustion engine is detected.

2. A system according to claim 1, wherein said variable resistance means includes a field effect transistor having drain, source and gate electrodes, said gate electrode being connected to said resistance control means, and a resistance value between said drain and source electrodes being varied by said resistance control means.

3. An air-fuel ratio detecting system for internal combustion engines comprising:

oxygen detecting means disposed in an exhaust passage of an internal combustion engine for detecting an absence and presence of oxygen, said oxygen detecting means exhibiting a low resistance and a high resistance in response to said absence and said presence of oxygen in said exhaust passage, respectively;

variable resistance means connected in series with said oxygen detecting means, said variable resistance means including first resistor means, and a series circuit of second resistor means and switch means, said series circuit being connected in parallel with said first resistor means;

power supply means for supplying a series circuit of said oxygen detecting means and said variable resistance means with an electric power so that said series circuit develops a first and a second voltages in response to said low resistance and said high resistance of said oxygen detecting means, respectively, at a junction between said oxygen detecting means and said variable resistance means;

sampling means for sampling a maximum value of larger one of said first and second voltages and a minimum value of smaller one of said first and second voltages during a sampling period;

calculation means for calculating a reference value in proportion to both of said maximum and minimum values;

resistance control means for controlling a resistance of said variable resistance means in response to said reference value, said resistance control means being connected to the switch means of said variable resistance means to turn on and off said switch means; and comparison means for comparing said first and second voltages with said reference value so that an air-fuel ratio of mixture supplied to said internal combustion engine is detected.

4. A system according to claim 3, wherein said sampling means comprises a lean peak sample circuit and a rich peak sample circuit, each thereof includes:

a capacitor for storing a charge corresponding to a respective peak value of said first and second voltages;

a diode connected to said capacitor for blocking discharging of said capacitor; and switch means connected in parallel with said capacitor for discharging the charge in said capacitor.

* * * * *